US005307599A

United States Patent [19]

Herbst et al.

[11] Patent Number: 5,307,599

[45] Date of Patent: May 3, 1994

[54] WINDOW GRILL ASSEMBLY AND METHOD FOR ASSEMBLING SAME

[75] Inventors: Walter B. Herbst, Evanston; James F. Caruso, Chicago, both of Ill.

[73] Assignee: Emco Specialties, Inc., Des Moines, Iowa

[21] Appl. No.: 957,161

[22] Filed: Oct. 7, 1992

[51] Int. Cl.[5] ..... E06B 1/30; E04C 2/38

[52] U.S. Cl. ..... 52/207; 52/456; 52/507; 52/656.1; 52/656.4; 52/656.8

[58] Field of Search ..... 52/207, 204.51, 204.61, 52/204.71, 204.72, 656.1, 656.2, 656.4, 656.5, 656.6, 656.7, 656.8, 456, 457, 458, 507; 49/505

[56] References Cited

U.S. PATENT DOCUMENTS

| | | | |
|---|---|---|---|
| 3,070,197 | 12/1962 | Musselman | 52/656.4 |
| 3,678,651 | 7/1972 | Hicks | 52/204.61 |
| 4,280,309 | 7/1981 | Huelsekopf | 52/656.5 |
| 4,407,100 | 10/1983 | Huelsekopf | 52/455 |
| 4,644,721 | 2/1987 | Bloomquist et al. | 52/507 |
| 4,782,630 | 11/1988 | Kleyn | 49/505 |
| 4,970,840 | 11/1990 | Ouellette et al. | 52/204.61 |
| 4,989,381 | 2/1991 | De Block et al. | 52/204.51 |
| 5,040,347 | 8/1991 | Valvis | 52/456 |

*Primary Examiner*—Carl D. Friedman
*Assistant Examiner*—Christopher T. Kent
*Attorney, Agent, or Firm*—Zarley, McKee, Thomte, Voorhees & Sease

[57] ABSTRACT

A window grill assembly includes a window frame having a window opening therein. A grill frame is positioned on one side of the window opening, and retaining frame is positioned on the opposite side. The grill frame includes one flange which engages the front surface of the window frame, and the retaining frame also includes a retaining flange which engages the rear surface of the door frame. A second grill flange extends into the window opening and engages a second retaining flange also within the window opening. The second grill flange and the second retaining flange are secured together to hold the grill frame, the window frame, and the retaining frame together.

11 Claims, 4 Drawing Sheets 4321
12
10
14

76
68
66
74
80
74
72
48
82
86
84
48
46
44
42
12
70
78
84
20
18
16
14
24
26
40

12
24
26
28
30
40
36
38
46
42
44
48
54
56
30
38
36
48
56
54

16
80
86
82
46
26
24
60
64
90
88
92
94
78
66
70
62
74
42
28
18
44
14
22
20

WINDOW GRILL ASSEMBLY AND METHOD FOR ASSEMBLING SAME

BACKGROUND OF THE INVENTION

The present invention relates to a window grill assembly and method for assembling same.

Window assemblies, and particularly window assemblies for use in storm doors, often require a grill or lattice work which fits over the window so as to give the impression that the window is comprised of several smaller window panes. Therefore, a primary object of the present invention is the provision of an improved window grill assembly and a method for assembling same.

A further object of the present invention is the provision of a window grill assembly including a grill frame and a retainer frame which are adapted to be positioned on the opposite sides of a window frame having a window opening therein.

A further object of the present invention is the provision of an improved window grill assembly which includes a grill frame and a retainer frame which are detachably securable together so as to embrace a window frame therebetween.

A further object of the present invention is the provision of an improved window grill assembly which can be made of plastic and which, once assembled, will be firmly secured together.

A further object of the present invention is the provision of an improved window grill assembly which is economical to manufacture, durable in use, and efficient in operation.

SUMMARY OF THE INVENTION

The foregoing objects can be achieved with a window grill assembly comprising a grill frame and a retainer frame. The grill frame and the retainer frame are adapted to be positioned on opposite sides of a window frame having a window opening therein. The grill frame includes a first perimetric grill flange having a surface parallel to and in facing engagement with the front surface of the window frame. The grill frame includes a second grill flange which extends into the window opening.

The retainer frame is positioned on the opposite side of the window frame from the grill frame, and includes a first retainer flange in facing engagement with the rear surface of the window frame and a second retaining flange which protrudes within the window opening. The second retaining flange of the retainer frame and the second grill flange of the grill frame each include ratchet teeth which engage one another and secure the grill frame to the retainer frame with the window frame being embraced therebetween.

The grill frame additionally includes a plurality of elongated ribs which are adapted to fit within corresponding grooves in the retainer frame. This rib and groove arrangement holds the retainer frame in registration with the grill frame when the two are secured together.

The grill frame also includes a plurality of hook members which retentively fit within a plurality of hook receiving openings for further securing the grill frame to the retainer frame.

A screen assembly is fitted within the window opening and is attached to the window frame, the retainer frame, or the grill frame so as to hold the screen in place. A storm window may be attached to the retainer frame for closing the window opening. The screen frame is preferably positioned between the grill frame and the glass of the storm window.

DESCRIPTION OF THE PREFERRED EMBODIMENT

Figures 1, 2:
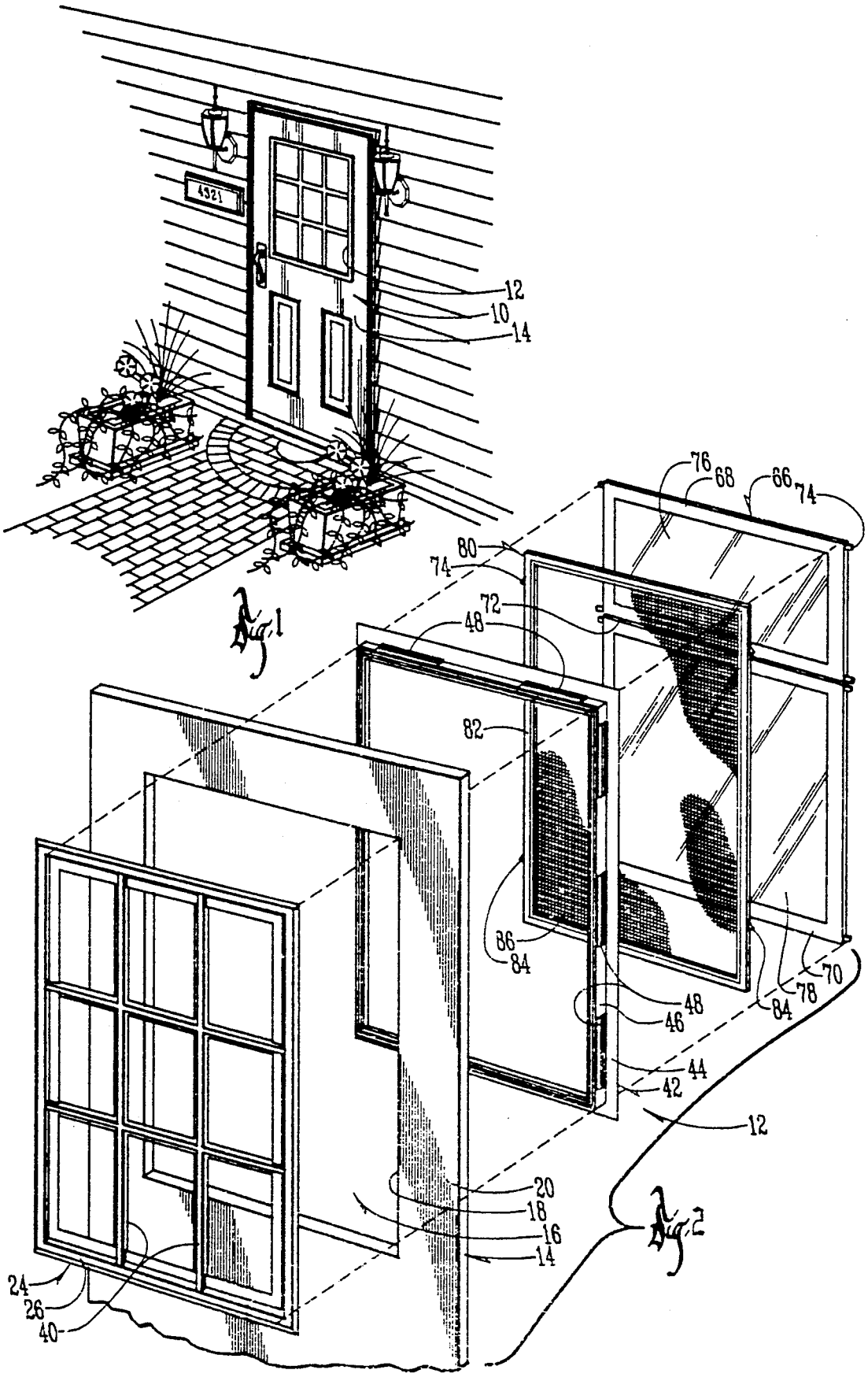
FIG. 1 is a perspective view of a door having the grill assembly of the present invention attached thereto.
FIG. 2 is an exploded view of the grill assembly.
Figure 3:
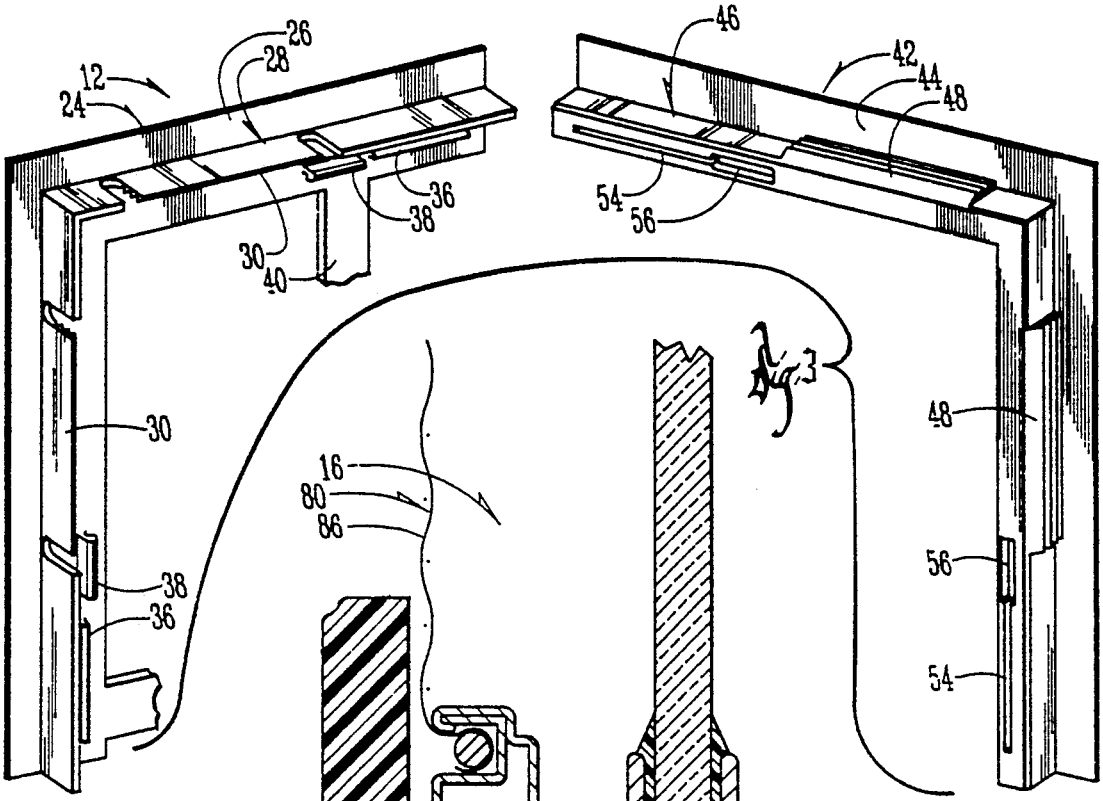
FIG. 3 is a partial perspective view of the grill frame and the retainer frame of the present invention.

Referring to the drawings the numeral 10 generally designates a door having the grill assembly 12 mounted therein. Door 10 includes a door or window frame 14 which defines a window opening 16 having a window perimeter 18, a front face 20, and a rear face 22. Front and rear faces 20, 22 are spaced apart a predetermined thickness which corresponds to the thickness of the door or window frame 14.

Figure 8:
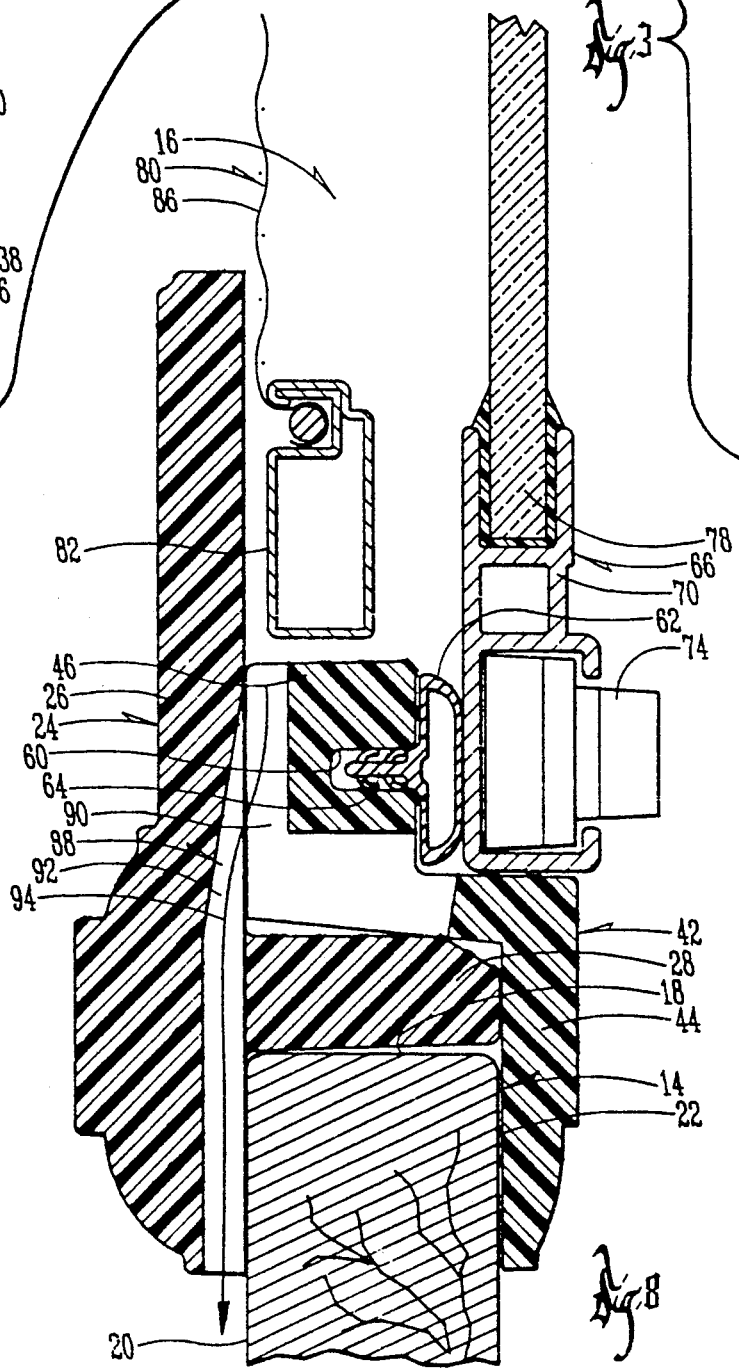
FIG. 8 is an enlarged sectional view showing the appearance of the fully assembled grill assembly when taken along line 8—8 of FIG. 4.
Figure 6:
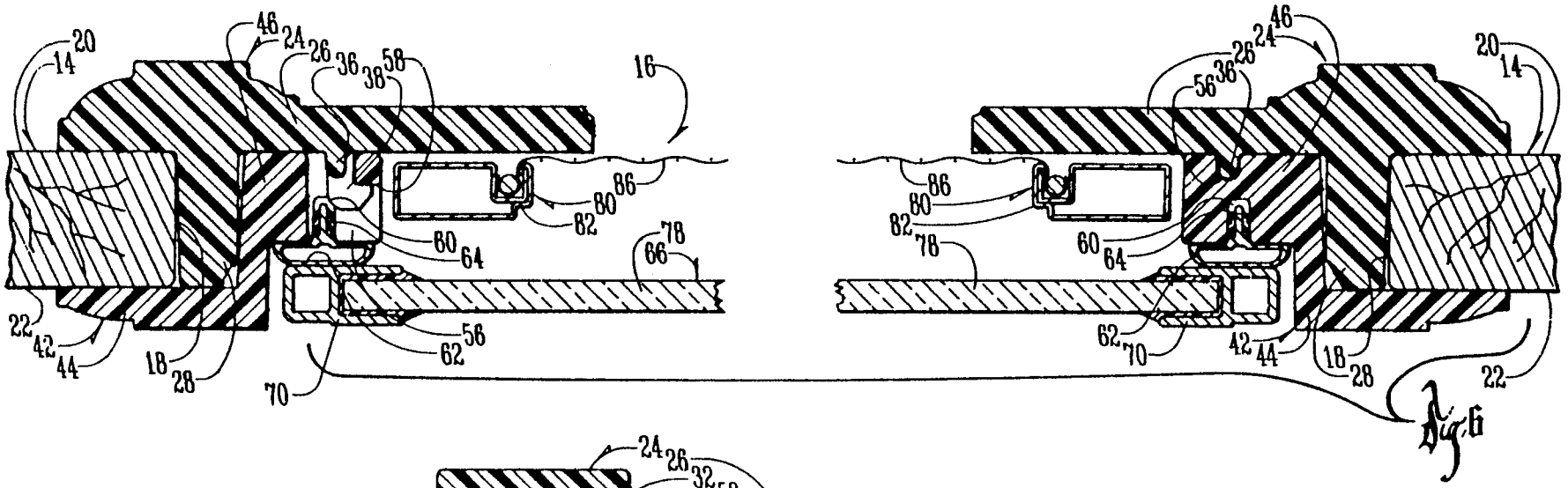
FIG. 6 is a sectional view showing the appearance of the fully assembled grill assembly when taken along line 6—6 of FIG. 4.

A grill frame 24 includes a first grill flange 26, and a second grill flange 28. First flange 26 is positioned to lie in a vertical plane which is in facing engagement with the front face 20 of window frame 14. Second grill flange 28 is perpendicular to first grill flange 26 and is adapted to protrude within the window opening 18 as shown in FIG. 6–8.

Figure 7:
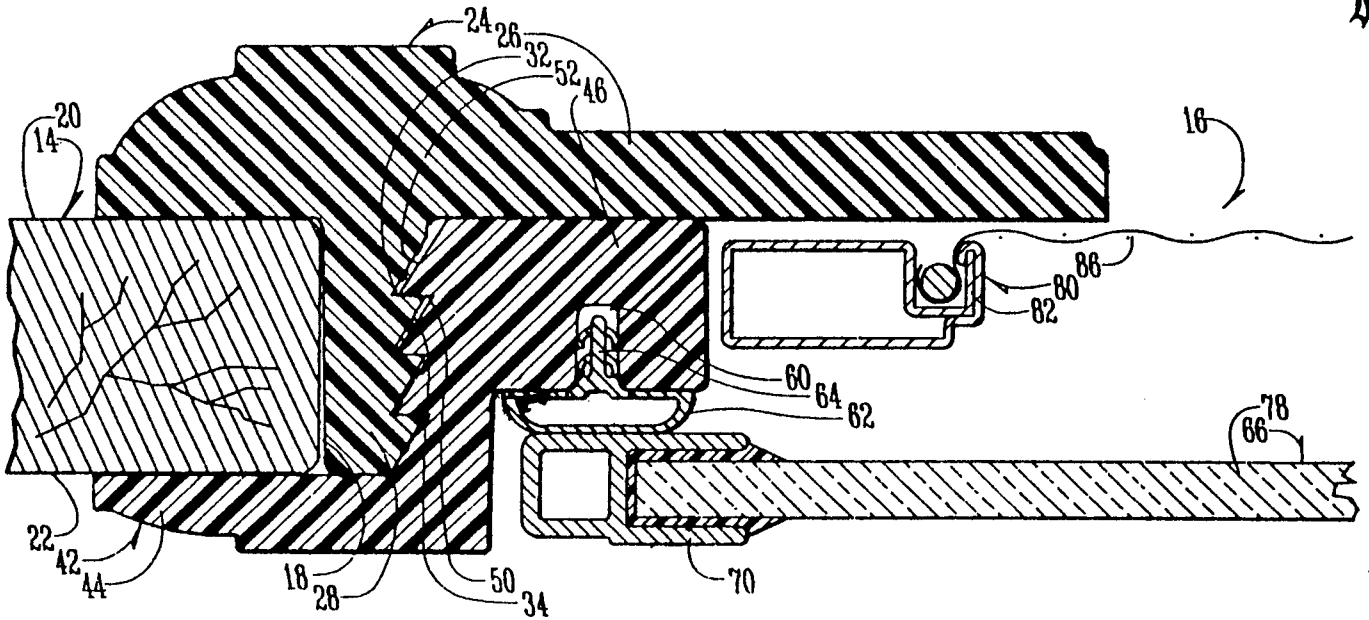
FIG. 7 is a sectional view showing the appearance of the completed assembly when taken along line 7—7 of FIG. 4.

Referring to FIG. 7, second grill flange 28 includes a plurality of grill ratchet teeth 30 thereon. Each of the ratchet teeth 30 include a stop surface 32 and a ramp surface 34. Also included on grill frame 24 are a plurality of elongated ribs 36 and a plurality of elongated hook members 38. The grill frame also includes a plurality of lattice members 40 which are criss-crossed to form a plurality of rectangular openings creating the visual impression of a plurality of small window panes.

A retaining frame 42 includes a first perimetric flange 44 and a second flange 46. First flange 44 is in an approximate vertical plane and is in facing engagement with the rear surface 22 of window frame 14. The second flange 46 includes a plurality of retainer ratchet teeth 48, each of which includes a stop surface 50 positioned in facing engagement with stop surface 32 of the grill ratchet teeth, and a ramp surface 52 adapted to face the ramp surface 34 of each of the grill ratchet teeth 30 (FIG. 7). Second retaining flange 46 also includes a plurality of elongated slots 54 therein which are adapted to register with and receive the elongated ribs 36 on the grill frame 24, thereby simultaneously aligning both the longitudinal and transverse axis of the grill frame 24 and retaining frame 42 so that they are approximately coextensive with each other. Slots 54 guide the ribs 36 so grill frame 24 assembles coextensively with retaining frame 42. Thus, grill assembly 12 easily fits within the window opening 16 without the need for further alignment of the individual components. At the end of each slot 54 is a hook receiving opening 56 which includes a hook stop 58 (FIG. 6) for retentively engaging the hook members 38. Also provided in the rearwardly facing surface of second retaining flange 46 is an elongated seal receiving groove 60 which receives a seal stem 64 of an elongated elastomeric seal 62. Fitted against seal 62 is a rectangular storm window assembly 66 having an upper storm window frame 68 and a lower storm window frame 70 which are hinged together about a horizontal axis by means of hinge 72. Storm window assembly 66 includes a plurality of bayonets 74 which are adapted to be received in bayonet slots (not shown) within retainer frame 42 so as to secure the window frame 66 to retainer frame 42 in the position shown in FIGS. 6–8. Fitted within upper storm window frame 68 is an upper glass panel 76, and fitted within lower storm window frame 70 is a lower glass panel 78.

A screen assembly 80 is fitted within the window opening 16 between the storm window assembly 66 and the grill assembly 24. Screen assembly 80 is comprised of a screen frame 82 having four or more bayonets 84 extending outwardly therefrom for retentively engaging bayonet slots (not shown) within retainer frame 42 so as to hold the screen frame in a rigid position between the storm window assembly 66 and the grill frame 24. A screen 86 is attached to the screen frame 82.

Figure 5:
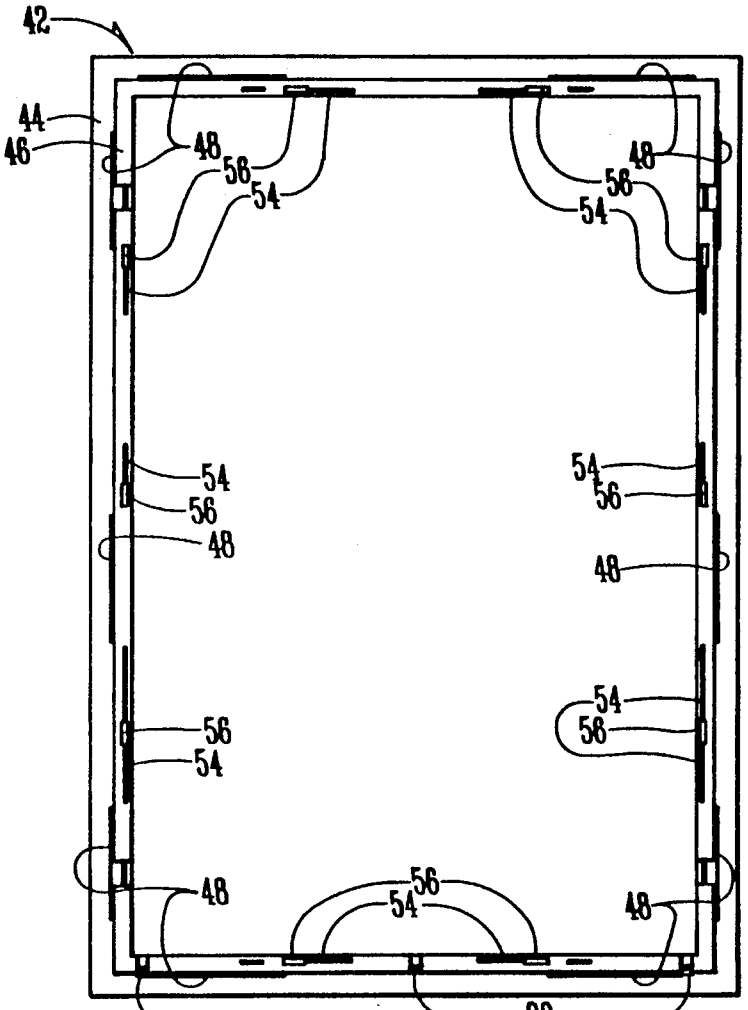
FIG. 5 is a plan view of the retainer frame of the present invention.
Figure 4:
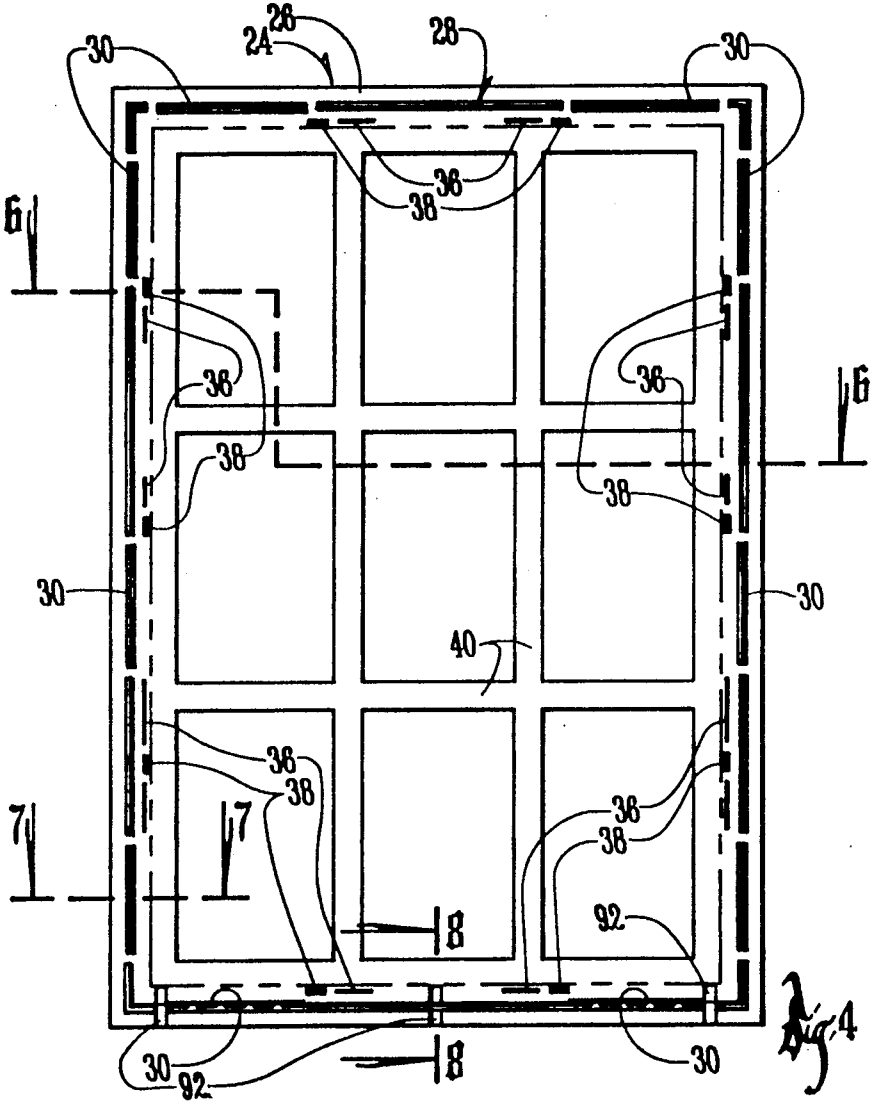
FIG. 4 is a plan view of the grill frame of the present invention.

Referring to FIG. 8, weep holes 88 are shown for draining water or condensation from between the grill frame 24 and the retainer frame 42. Weep holes 88 are formed by three weep grooves 90 which are formed in the bottom horizontal portion of the first retaining flange 44 of retainer frame 42 (FIG. 5). In communication with the lower ends of weep grooves 90, are three additional weep grooves 92 which are formed out of the inwardly facing surface of the first grill flange 26 of grill frame 24 (FIG. 4). This permits water to drain out from between grill frame 24 and retainer frame 42 in the direction indicated by arrow 94 (FIG. 8).

Grill assembly 10 is assembled by placing grill frame 24 and retainer frame 42 on opposite sides of the window frame 14 as shown in FIG. 2. Then grill frame 24 and retainer frame 42 are moved toward each other until second grill flange 28 and second retaining flange 46 are positioned within the interior of window opening 16. In this position, the grill frame 24 and the retainer frame 42 are registered with one another; the grill ratchet teeth 30 are registered with the retainer ratchet teeth 48; the hooks 38 are registered with the hook receiving openings 56; and the elongated ribs 36 are in registered alignment with the elongated slots 54. Continued movement of the grill frame 24 toward the retainer frame 42 causes the grill ratchet teeth 30 to engage the retainer ratchet teeth 48 as shown in FIG. 7. Initially only one of the grill ratchet teeth 30 engage one of the retainer ratchet teeth 48, but continued movement of the grill frame 24 toward the retainer frame 42 causes the grill teeth 30 and the retainer teeth 48 to ride over one another until all or part of the teeth are engaging one another. This permits the first retaining flange 44 and the first grill flange 26 to be forced into snug engagement with the rear and front surfaces 20, 22 of window frame 14 all as shown in FIG. 7.

At the same time that the ratchet teeth are engaged, the elongated ribs 36 are matingly fitted within the elongated grooves 54, and the hook members 38 are moved into retentive engagement with the hook stops 58 as shown in FIG. 6. The fitting of the ribs 36 within the slots 54 prevents the second retaining flanges 48 from being bowed inwardly in response to the engagement of the ratchet teeth 30, 48. Similarly, the engagement of hooks 38 with hook stops 58 causes the first grill flanges 26 to be held against movement away from first retaining flanges 46. The result is a strongly attached assembly which can be made of plastic.

After assembly of the grill frame 24 and the retaining frame 42, the screen assembly 80 can be moved into place as shown in FIG. 6, and be secured in place by fitting bayonets 84 into complimentary bayonet slots (not shown) in the retaining frame 42 in conventional manner.

Similarly, the storm window assembly 66 can be moved into place as shown in FIG. 6 and secured there by means of bayonets 74 which fit within bayonet slots (not shown) in retaining frame 42.

If water or condensation fall into the space between the grill frame 24 and the retaining frame 42, the water will be drained outwardly through weep hole 88 which is formed by the two weep grooves 90, 92.

The preferred embodiment of the invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit or scope of the invention as further defined in the following claims.

We claim:

1. A Window grill assembly comprising:

a window frame having a window perimetric edge defining a window opening, said window frame having first and second opposite faces spaced apart from one another to define a window frame thickness;

a grill frame having a first perimetric grill flange forming a first grill flange surface and in facing engagement with said first face of said window frame adjacent said window perimetric edge, said grill frame having a second grill flange extending within said window opening between said first and second opposite faces of said window frame;

a retaining frame having a first perimetric retaining frame flange forming a first retaining flange surface in facing engagement with said second face of said window frame adjacent said window perimetric edge, said retaining frame having a second retaining flange extending within said window opening between said first and second opposite faces of said window frame;

first alignment means on said grill frame;

second alignment means on said retainer frame; and one of said first and second alignment means comprising an alignment rib and the other of said first and second alignment means comprising an alignment groove, said alignment rib being matingly fitted within said alignment groove such that said first and second alignment means cooperate with one another to align said retaining frame in registered alignment with said grill.

2. A window grill assembly according to claim 1 wherein said alignment rib and said alignment groove are disposed parallel to a side of said window opening.

3. A window grill assembly according to claim 1 wherein a plurality of said alignment ribs and said alignment grooves are repeated rectilinearly around the perimeter of said frames.

4. A window assembly according to claim 1 wherein said securing means comprises a plurality of grill ratchet teeth on said second grill flange retentively engaging a plurality of retainer ratchet teeth on said retainer frame.

5. A window assembly according to claim 4 wherein said securing means further comprises hook means on one of said grill frame and said retaining frame and hook receiving means on the other of said grill frame and said retaining frame, said hook means retentively engaging said hook receiving means for holding said grill frame against movement away from said retaining frame.

6. A window assembly according to claim 4 wherein said ratchet teeth are integral with said second grill flange forming an integrated second grill flange which is made of a plastic material.

7. A window grill assembly according to claim 1 and further comprising hook means on one of said grill frame and said retaining frame and hook receiving means on the other of said grill frame and said retaining frame, said hook means retentively engaging said hook receiving means for holding said grill frame against movement away from said retaining frame.

8. A window grill assembly according to claim 7 and further comprising a screen assembly positioned within said window opening between said grill frame and said retaining frame.

9. A method for assembling a window grill assembly within a window opening of a window frame, said window frame having a window perimetric edge surrounding said window opening and having first and second opposite faces spaced apart from one another to define a window frame thickness; said method comprising:

forming a grill frame having a first grill flange surface lying in a first plane, said grill frame also having a second grill flange extending in a second plane perpendicular to said first plane, said second grill flange having first securing means, said grill frame also having an elongated rib protruding from said first grill flange surface;

taking a retaining frame having a first perimetric retaining frame flange forming a first retaining flange surface lying in a third plane, said retaining frame having a second retaining flange lying in a fourth plane perpendicular to said third plane, said second retaining flange having second securing means and a groove in said third place for receiving said rib and aligning said grill and retaining frames;

inserting said second retaining flange into said window with said first retaining flange surface facing toward said second opposite surface of said window frame;

aligning said rib with said groove and moving the former into the latter such that said grill and retaining frames are guided into alignment; and moving said grill frame toward said retaining frame to an assembled position whereby said first grill flange is in facing engagement with said first opposite surface of said window frame and said first retaining flange is in facing engagement with said second opposite surface of said window frame, said first and second securing means retentively engaging one another to hold said grill frame and said retaining frame in said assembled position.

10. A method according to claim 9 wherein one of said grill frame and said retaining frame includes hook means and the other of said grill frame and said retaining frame includes hook receiving means adapted to retentively engage said hook means, said moving step further comprising moving said hook means into retentive engagement with said hook receiving means.

11. A method according to claim 9 wherein said first and second securing means each comprise a plurality of ratchet teeth, said first and second securing means being capable of gripping one another in a plurality of positions each of which hold said grill frame and said retainer frame at a different distance from one another, said method further comprising moving said first and second securing means to the one of said plurality of positions wherein said first grill flange and said first retaining flange engage said first and second opposite faces respectively of said window frame.

* * * * *